United States Patent [19]

Eheim et al.

[11] 4,450,805

[45] May 29, 1984

[54] FUEL INJECTION PUMP FOR INTERNAL COMBUSTION ENGINES

[75] Inventors: Franz Eheim, Stuttgart; Gerald Höfer, Weissach-Flacht, both of Fed. Rep. of Germany

[73] Assignee: Robert Bosch GmbH, Stuttgart, Fed. Rep. of Germany

[21] Appl. No.: 415,947

[22] Filed: Sep. 8, 1982

[30] Foreign Application Priority Data

Nov. 24, 1981 [DE] Fed. Rep. of Germany ..... 3146499

[51] Int. Cl.[3] ..... F02D 23/02; F02D 1/06

[52] U.S. Cl. ..... 123/387; 123/380; 123/383; 123/503

[58] Field of Search ..... 123/387, 385, 386, 388, 123/380, 382, 383, 503; 417/282, 289, 294

[56] References Cited

U.S. PATENT DOCUMENTS

| | | | |
|---|---|---|---|
| 3,635,603 | 1/1972 | Eheim | 417/282 |
| 4,037,575 | 7/1977 | Sommars | 123/380 |
| 4,228,774 | 10/1980 | Ritter et al. | 123/383 |
| 4,308,834 | 1/1982 | Eheim | 123/387 |

FOREIGN PATENT DOCUMENTS

| | | | |
|---|---|---|---|
| 1911913 | 9/1970 | Fed. Rep. of Germany | 123/387 |
| 54-10830 | 1/1979 | Japan | 123/386 |
| 54-10831 | 1/1979 | Japan | 123/386 |
| 56-41429 | 4/1981 | Japan | 123/383 |

*Primary Examiner*—Ira S. Lazarus
*Assistant Examiner*—Magdalen Moy
*Attorney, Agent, or Firm*—Edwin E. Greigg

[57] ABSTRACT

A fuel injection pump is proposed in which the quantity adjustment member has a travel limitation device in the form of an adjustable stop, which is adjusted in accordance with the displacement of an adjusting piston in accordance with a contour formed in the jacket face thereon. The displacement of the adjusting piston is effected via rpm-dependent pressure of the suction chamber counter to the force of a restoring spring and counter to a pressure which can be established with the aid of a pressure control valve in accordance with engine operating parameters. The adjustment of the stop is thus effected with the high work capacity of the suction chamber pressure, and the limitation of the adjustment is attained with the aid of the modulated pressure diverted from the suction chamber pressure.

7 Claims, 2 Drawing Figures

FUEL INJECTION PUMP FOR INTERNAL COMBUSTION ENGINES

BACKGROUND OF THE INVENTION

The invention is directed to a fuel injection pump having a fuel quantity adjusting member and means associated therewith for varying the travel thereof. In an injection pump of this kind, such as is known from German Pat. No. 19 12 919, the full-load injection quantity is limited with the aid of an adjustable stop, which stop comprises a bell crank to scan a contour on an adjusting piston, which is adjustable counter to a spring in accordance with the rpm-dependent fuel pressure in a suction chamber of the injection pump. In this known embodiment, only an rpm-dependent adaptation of the full-load injection quantity is possible. Other operating parameters of the engine cannot be taken into consideration.

In another injection pump, such as is known from German Offenlegungsschrift No. 28 54 422, the full-load injection quantity is limited with the aid of an adjustable stop which is adjustable in accordance with the pressure of the air supplied to the combustion chambers of the engine, for instance, the charge pressure in the case of supercharged engines. To this end, a pressure box exposed to the charge pressure is provided which displaces an adjusting piston provided with a contour on its jacket face, and the contour is scanned mechanically.

A charge-pressure-dependent correction of the injection quantity of this type has the disadvantage that it is capable of compensating for dynamic variations in load only relatively slowly, in particular in the case of turbocharging apparatuses for compressing the aspirated air which are operated with exhaust gas, because the change in exhaust gas volume follows up the variation in fuel quantity only in a delayed manner. If the quantity adjusting device which comes to rest upon the stop is exposed to great forces, then in the adjustment of the stop there is a great amount of friction, which causes pronounced hysteresis on the part of the full-load adjustment. This behavior is all the more disadvantageous in the case of injection with a charge-pressure-dependent adaptation, when adjustment errors increase quite substantially as the rpm and load increase. The reason is that the supercharger characteristics of supply pressure in accordance with the load become flatter and flatter as the rpms increase, and form an increasingly smaller angle with the adaptation characteristic (adaptation quantity over charge pressure) obtained on the basis of the requirements of the particular engine.

In still a further known fuel injection pump, that disclosed in German Offenlegungsschrift No. 28 47 572, a 3-dimensional cam which determines the position of the full-load stop is on the one hand displaced by the rpm-dependent suction chamber pressure of the injection pump and on the other hand rotated in accordance with the charge pressure. A pressure box exposed to the charge pressure is used as the adjusting member then and the three-dimensional curve on the cam is scanned mechanically and transmitted to the full-load stop. This embodiment again has the disadvantage of friction involved in the scanning process, particularly when the governor spring forces are transmitted via the scanning device to the three-dimensional cam. Furthermore, the torque which the pressure box shown in this document is capable of exerting is small, given economical dimensions of the apparatus; thus, some means is required for further amplifying this adjusting force.

OBJECT AND SUMMARY OF THE INVENTION

It is a principal object of the present invention to provide an adjusting apparatus which overcomes the disadvantages of the prior art attempts to adjust full-load injection quantity. The present invention utilizes the operating parameters of the engine, and in particular the density of the air supplied to the engine, to provide a pressure which is modulated to affect the adjustment of the adjusting piston. The forces required for modulating this pressure are in that case no longer dependent on the forces which occur in the course of the mechanical scanning of the adjusting piston. Thus the control signal transducer, which may for example be made up of pressure boxes, may be relatively small in dimension. With such means, adjusting forces are generated without great expenditure of energy which are easily able to overcome friction at the adjusting piston without the danger of excessive hysteresis.

It is another object of the invention to provide an apparatus which is suitable for injection pumps in which the forces transmitted upon the adjusting piston in the course of mechanical scanning of the contour are already kept very small, because, for instance, the entire force of the governor spring apparatus is not exerted upon the adjusting piston.

The invention will be better understood and further objects and advantages thereof will become more apparent from the ensuing detailed description of two preferred embodiments taken in conjunction with the drawings.

DESCRIPTION OF THE PREFERRED EMBODIMENTS

Figure 1:
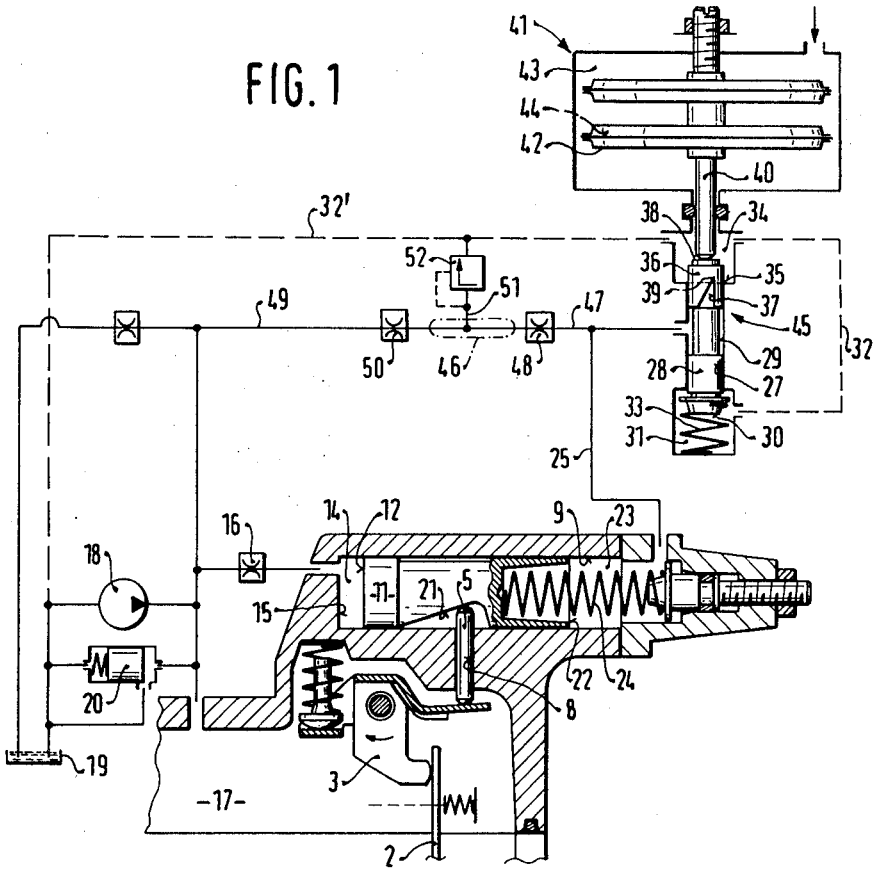
FIG. 1 is a partial schematic view of a first exemplary embodiment of an adjusting apparatus of the adjusting piston having a pressure control valve, which is adjusted directly by a pressure transducer.

In FIG. 1, a portion of a fuel injection pump is shown which may be a distributor-type injection pump by way of example. In a known manner, this pump has a fuel quantity adjusting member 2 comprising a lever, which actuates an annular slide, not otherwise shown, for controlling the fuel injection quantity. At the full-load position, possibly with the interposition of a bell crank 3, the adjusting member 2 rests on an adjusting stop 5, which comprises a scanning pin guided in a bore 8 to protrude at right angles into a cylinder 9 disposed in the housing. Guided in this housing is an adjusting piston 11, which on one end 12 encloses a work chamber 14 within the cylinder 9. The work chamber 14 communicates continuously via a throttle bore 16 located on the end 15 of the cylinder 9 with a chamber which is filled with a pressurized medium, the pressure of which is controlled in accordance with rpm. In the illustrated embodiment, this chamber comprises the fuel-filled suction chamber 17 of the fuel injection pump, and the supply of fuel is effected by means of a fuel pump 18 which aspirates fuel from a fuel supply container 19, the supply side of which can be relieved by way of a pressure control valve 20. As a result of this construction, an rpm-dependent pressure is established in a known manner in the suction chamber 17.

The adjusting piston 11 is provided with a contour 21 on its jacket face, opposite to the bore 8 through which the scanning pin 5 is introduced into the cylinder 9, by means of which contour the position of the the adjusting piston is determined by translating piston displacement into scanning pin displacement. The rear portion 22 of the adjusting piston 11 partially encloses a pressure chamber 23 in the cylinder 9 and a restoring spring 24 acting upon the rear portion 22 of the adjusting piston 11 is disposed therein. A pressure line 25 leads away from the pressure chamber 23 and discharges into a cylinder bore 27 of a pressure control valve 45. A control slide 28 is displaceably disposed in this cylinder bore 27 and in the vicinity of the mouth of the pressure line 25 provided with an annular groove 29. The annular groove 29 is long enough that while the displaceability of the control slide 28 is taken into consideration, the pressure line 25 remains in continuous communication with the annular groove 29. Via a first end face 30, the control slide 28 serves to seal a chamber 31 in a lower extremity of cylinder bore 27. This chamber is relieved via a relief line 32 and provided with a compression spring 33 fastened within it to act upon the first end face 30.

The cylinder bore 27, at the end located opposite the chamber 31, discharges into a relief chamber 34 of enlarged diameter, so that a control edge 35 is formed at the transition from the cylinder bore 27 to the relief chamber 34. A relief line 32' leads away from the relief chamber 34, for instance to the intake side of the supply pump 18. A triangulated recess 37 is formed in the jacket face on the piston part 36 of the control slide 28 beginning at the annular groove 29 and extending in the direction of the relief chamber 34. The vertex of the recess 37 points in the direction toward the relief chamber 34, and given a corresponding deflection of the control slide 28 it comes to meet the control edge 35. At this point, depending on the deflection of the control slide 28, a relief passage 39 of greater or lesser size is revealed between the limiting edge of the recess 37 and the control edge 35, as is shown in the drawing with dashed lines.

An adjusting pin 40 protrudes into the relief chamber 34 from the opposite side coaxially with the control slide 28, being actuatable by an adjusting device 41, and comes to rest on an opposite end face 38 of the control slide 28. The adjusting device 41, in the illustrated example, comprises an adjusting diaphragm 42 to which the adjusting pin 40 is articulated and which divides a control pressure chamber 43 from a reference pressure chamber 44. The reference pressure may be either atmospheric pressure or a constant pressure, for instance the vacuum in a barometer box. The control pressure in the control pressure chamber is the pressure which determines the density of the air supplied to the combustion chambers of the engine. This may be the charge pressure, for example, or in the case of non-super-charged engines, ambient pressure, in accordance with which the control slide 28 is displaced and the relief passage 39 is varied.

The unit comprising the adjusting device 41 and the control slide 28 thus comprise a pressure control valve 45, with the aid of which the pressure in the pressure chamber 23 is controlled in accordance with operating parameters, in particular the charge pressure or the air pressure. The pressure source 46 for furnishing the initial pressure communicates with the pressure line 25 via a connecting line 47 in which an uncoupling throttle 48 is disposed. By permitting pressure medium to flow out downstream of the uncoupling throttle, a pressure can be established with the aid of the pressure control valve 45 which is less than the initial pressure of the pressure source 46.

In the illustrated embodiment, the pressure source 46 is met by a fuel line 49 which branches off from the suction chamber 17 and has a second throttle 50 disposed therein; the fuel line 49 leads to the uncoupling throttle 48. A relief line 51 also branches off from the fuel line 49 between the uncoupling throttle 48 and the second throttle 50; a pressure limiting valve 52 is disposed in the relief line 51. The effect is that a constant pressure prevails in the zone between the uncoupling throttle 48 and the second throttle 50 as long as the supply of pressure from the suction chamber 17 is sufficient.

In the described apparatus, when the engine is turned on the rpm-dependent pressure is built up in the work chamber 14, so that the adjusting piston 11 is deflected in accordance with this pressure, counter to the force of the restoring spring 24. The scanning pin 5 is displaced in accordance with the contour 21. However, a hydraulic pressure is also exerted upon the rear portion 22, determined by the pressure control valve 45 and acting counter to the pressure in the work chamber 14. This pressure more or less limits the deflectability of the adjusting piston 11, so that the adjusting piston 11 is adjustable in accordance with the rpm, but the maximum adjustment can only be within the limits established by the charge pressure. The high work capacity of the suction chamber pressure can be exploited here for adjusting the full-load stop, and the resultant adjusting pressure is modified with little expenditure of energy.

Figure 2:
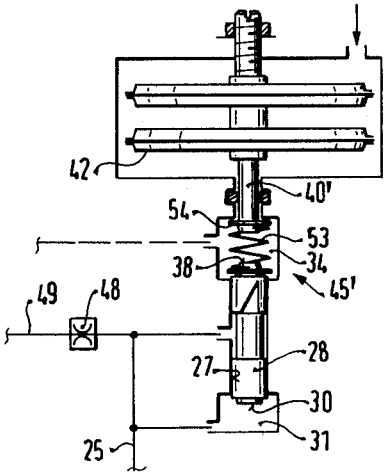
FIG. 2 is a cross-sectional view of a variant upon the exemplary embodiment of FIG. 1 in which details of the pressure transducer which varies the initial stress of a restoring spring acting upon the control slide are shown.

One variant of the pressure control valve 45 of FIG. 1 is shown in the form of the pressure-control valve 45' of FIG. 2. Here again, the control slide 28 seals a chamber 31 within the cylinder bore 27 with its one end 30, but this chamber 31 now communicates directly with the pressure line 25, so that the controlled pressure prevails there. The spring which restores the control slide 28 counter to this pressure is now disposed in the form of a control spring 53 in the relief chamber 34 and acts upon the opposite end face 38 of the control slide 28. The control spring 53 is supted on the end, provided with a spring plate 54, of an adjusting pin 40' which is adjustable, as in the first example discussed above, by an adjusting diaphragm 42.

In this embodiment, the mass acting upon the adjusting diaphragm 42 and the influence of frictional forces are smaller, so that in this case less hysteresis in controlling the pressure in the pressure chamber 34 should be expected.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel-injection pump for internal combustion engines having a fuel quantity adjusting member arranged to traverse a travel and means associated therewith for varying said travel operable as an adjusting device, said adjusting device comprising an adjusting piston disposed in a cylinder, said piston being adjustable counter to a restoring spring, the travel of said quantity adjusting member being varied in accordance with movement of said adjusting piston via a transmission means, said adjusting piston being provided with two opposite extremities, a first of which defines with said cylinder a work chamber, said work chamber being filled with a fluid source of pressure, said pressure being varied in accordance with rpm of said fuel injection pump, characterized in that the second extremity of said adjusting piston defines with said cylinder a pressure chamber in which said restoring spring is disposed, said pressure chamber being filled with a fluid source of pressure and communicating with means for varying said pressure therein in accordance with at least one operating parameter of the engine and said pressure in said pressure chamber serves to supplement a force supplied by said restoring spring, whereby an adjusting force is applied to said adjusting piston.

2. A fuel injection pump as defined by claim 1, further characterized in that said means for varying pressure in said pressure chamber includes an uncoupling throttle in communication with a pressure source and further includes a pressure control valve provided with a relief chamber, said pressure control valve controlling pressure to said pressure chamber dependent upon said at least one operating parameter.

3. A fuel injection pump as defined by claim 2, further characterized in that the pressure control valve is provided with a control slide displaceable via an adjusting member in accordance with said at least one operating parameter counter to a second restoring spring, said displaceable control slide controlling a relief passage.

4. A fuel injection pump as defined by claim 2, further characterized in that the pressure control valve is provided with a control slide displaceably disposed in a bore, said control slide being provided with end faces, a first end face serving to seal a chamber communicating with the pressure chamber and being subjected to a spring, an initial force of which spring varies in accordance with said at least one operating parameter, said pressure control valve being further provided with a control edge associated with said control slide for controlling a relief passage.

5. A fuel injection pump as defined by claim 3 or 4, characterized in that said control slide is provided with an annular groove communicating continuously via a pressure line with the pressure chamber and said relief passage comprises a limiting edge having a longitudinal extent provided on said control slide, said longitudinal extent adapted to be revealed upon movement of said control slide with relation to a control edge.

6. A fuel injection pump as defined by claim 5, further characterized in that said control slide has a jacket face, the limiting edge defines a recess branching off from the annular groove on said jacket face, and the control edge comprises a transitional edge between the bore and a relief chamber of enlarged diameter.

7. A fuel injection pump as defined by claim 1, characterized in that a pressure line leads from the source of pressure to a second throttle and an uncoupling throttle disposed in series therein, and finally to the pressure chamber, a relief line is provided to the pressure line between the second throttle and the uncoupling throttle, and the relief line includes a pressure limiting valve, whereby pressure prevailing between the two throttles can be held at a constant value while the fuel injection pump is in operation.

* * * * *